United States Patent [19]

Zdenek et al.

[11] Patent Number: 5,060,722

[45] Date of Patent: Oct. 29, 1991

[54] FURNACE HEAT EXCHANGER

[75] Inventors: Peter E. Zdenek, Trenton, N.J.; James T. VerShaw, Tyler, Tex.

[73] Assignee: American Standard, Inc., New York, N.Y.

[21] Appl. No.: 610,887

[22] Filed: Nov. 6, 1990

[51] Int. Cl.[5] ..... F28F 3/14; F28D 1/03

[52] U.S. Cl. ..... 165/170; 165/147; 126/99 R; 126/110 R

[58] Field of Search ..... 165/147, 170; 126/99 R, 126/110 R, 116 R

[56] References Cited

U.S. PATENT DOCUMENTS

| | | | |
|---|---|---|---|
| 3,399,661 | 9/1968 | Kreis | 126/118 |
| 3,661,140 | 5/1972 | Raleigh | 126/110 R |
| 4,467,780 | 8/1984 | Ripka | 126/110 R |
| 4,476,850 | 10/1984 | Pickering | 126/112 |
| 4,603,680 | 8/1986 | Dempsey et al. | 126/99 |
| 4,619,604 | 10/1986 | Pickering | 431/353 |
| 4,648,551 | 3/1987 | Thompson et al. | 236/49 |
| 4,660,761 | 4/1987 | Bussjager | 237/2 |
| 4,688,547 | 8/1987 | Ballard et al. | 126/116 |
| 4,703,747 | 11/1987 | Thompson et al. | 126/112 |
| 4,706,881 | 11/1987 | Ballard | 236/15 |
| 4,707,646 | 11/1987 | Thompson et al. | 318/332 |
| 4,729,207 | 3/1988 | Dempsey et al. | 126/112 |
| 4,738,307 | 4/1988 | Bentley | 165/133 |
| 4,739,746 | 4/1988 | Tomlinson | 126/110 |
| 4,776,320 | 10/1988 | Ripka et al. | 126/99 |
| 4,792,089 | 12/1988 | Ballard | 236/11 |
| 4,807,588 | 2/1989 | Bentley et al. | 126/110 |
| 4,982,785 | 1/1991 | Tomlinson | 165/170 |

FOREIGN PATENT DOCUMENTS

| | | | |
|---|---|---|---|
| 2016560 | 11/1971 | Fed. Rep. of Germany | 126/116 R |

*Primary Examiner*—Allen J. Flanigan

*Attorney, Agent, or Firm*—William J. Beres; William O'Driscoll

[57] ABSTRACT

A serpentine passage for a gas furnace clam shell-type heat exchanger comprising a serpentine passage having an inlet and an outlet where the serpentine passage, from the outlet toward the inlet, is shaped as a leaning, cursive w with the trailing end curling downwardly and underlining the w.

16 Claims, 2 Drawing Sheets

FIG. 2
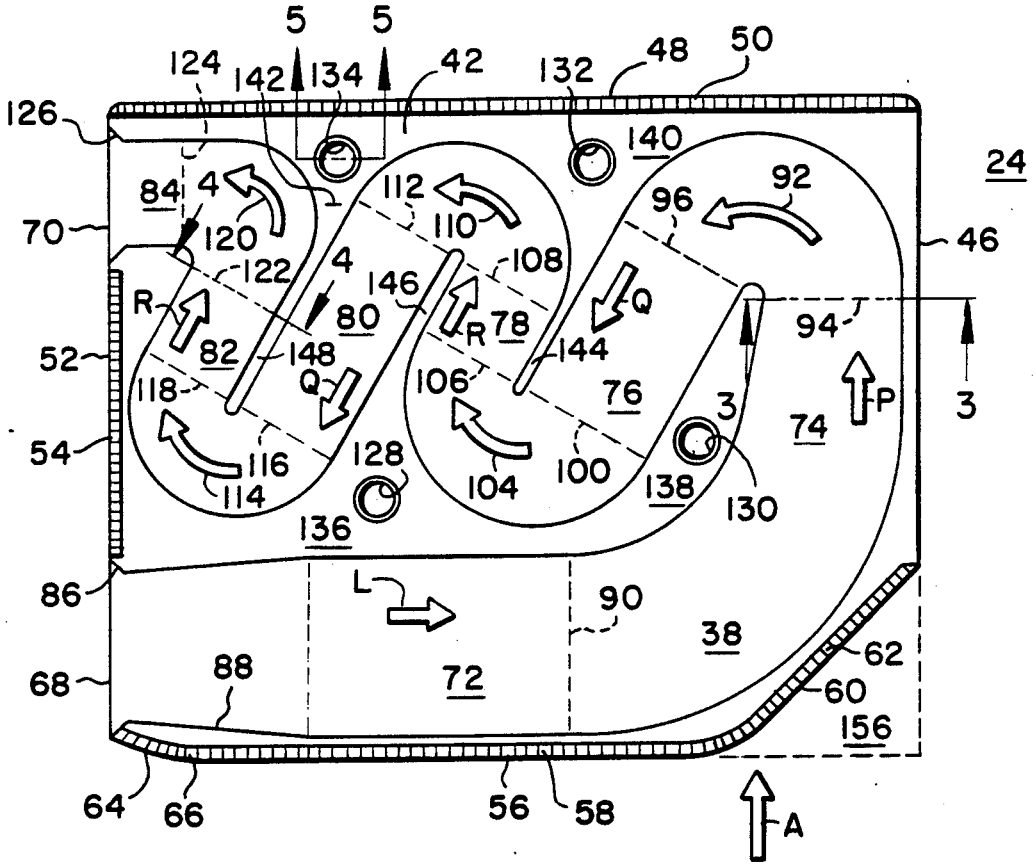
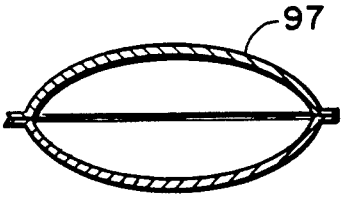
FIG. 3
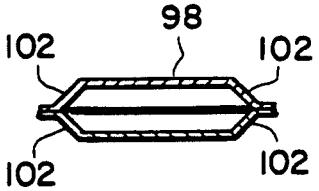
FIG. 4
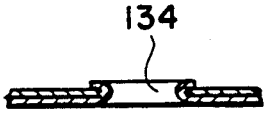
FIG. 5

FURNACE HEAT EXCHANGER

BACKGROUND OF THE INVENTION

The present invention is directed to a heat exchanger for a gas furnace, and more particularly to the arrangement of a serpentine combustion gas passage.

In a gas furnace, a plurality of heat exchangers are spaced apart to allow airflow and heat exchanger in the interstices therebetween. Each heat exchanger is formed from stamped planar surfaces enclosing a serpentine combustion passage which contains the hot flue gases. Heat is transferred through the walls of the serpentine passage to heat air passing between the plurality of heat exchangers and among the interstices. The heated air is then transferred to a zone requiring heating.

The transfer of heat from the enclosed serpentine passage to the airflow around the heat exchangers is facilitated by maximizing the length and area of the serpentine passage. U.S. Pat. No. 4,739,746 to Tomlinson is an example of a serpentine passage which provides a relatively long passage in a confined space. However, the arrangement of the Tomlinson patent can be optimized to provide a longer passage in a smaller confined space, thereby providing greater efficiency in heat transfer. Additionally, the arrangement is such that a cold spot, leading to deterioration of the heat exchanger material, is formed at the end of the first leg of the Tomlinson heat exchanger.

SUMMARY OF THE INVENTION

It is an object of the invention to solve the problems of prior art gas furnace heat exchangers.

It is an object, feature and advantage of the present invention to maximize the length of the combustion gas passage.

It is an object, feature and advantage of the present invention to eliminate cold spots in the heat exchanger.

It is an object, feature and advantage of the present invention to maximize the heat transfer surface area of a gas furnace heat exchanger.

It is an object, feature and advantage of the present invention to provide a combustion gas passage which has a very gradual, sweeping and generous radius at the first turn.

It is an object, feature and advantage of the present invention to provide a clam shell heat exchanger which does not require spot welding, dimples or distinct mechanical fasteners.

It is an object, feature and advantage of the present invention to provide a clam shell heat exchanger with a height which is less than other designs.

It is an object, feature and advantage of the present invention improve airflow by increasing the area between the blowers and the heat exchanger.

It is an object, feature and advantage of the present invention to provide a passage pattern where the circulating airflow passes over the center of the combustion gas passage more frequently then other designs.

It is an object, feature and advantage of the present invention to provide a serpentine combustion gas passage which is substantially longer than comparable combustion gas passages.

The present invention provides a serpentine passage for a gas furnace clam shell-type heat exchanger comprising a serpentine passage having an inlet and an outlet where the serpentine passage, from the outlet toward the inlet, is shaped as a leaning, cursive w with the trailing end curling downwardly and underlining the w.

The present invention provides a furnace heat exchanger comprising a pair of joined planar surfaces having a serpentine passage shaped therebetween. The passage includes an inlet; an outlet; a burner path connected to the inlet and extending in a first direction; a transition leg connected to the burner path and altering the serpentine passage to a second direction perpendicular to the first direction; a first oblique path connected to the transition leg and extending in a third direction toward the burner path, the third direction is oblique to the first direction and to the second direction; a second oblique path connected to the first oblique path and extending in a fourth direction away from the burner path where the fourth direction is generally parallel to the third direction; and an outlet path between the outlet and the second oblique path.

The present invention provides a serpentine path from an inlet of a furnace heat exchanger to an outlet of a furnace heat exchanger. The serpentine path comprises a burner path connected to an inlet and linearly running in a first direction; a transition leg connected to the burner leg and turning the serpentine path from the first direction to a second direction which is substantially perpendicular to the first direction; a first turn connected to the transition leg and turning the serpentine path from the second direction to a third direction which is oblique to the second direction; a first oblique leg connected to the first turn and extending in the third direction toward the burner path; a second turn connected to the first oblique leg and turning the serpentine path approximately 180°; a second oblique leg connected to the second turn and extending in a fourth direction which is substantially parallel to the third direction; a third turn connected to the second oblique leg and turning the serpentine path approximately 180°; a third oblique path connected to the third turn and extending in the third direction; a fourth turn connected to the third oblique leg and turning the serpentine path approximately 180°; a fourth oblique leg connected to said fourth path and extending in the fourth direction; an outlet turn connected to the fourth oblique path and turning the serpentine path in a fifth direction which is opposite to and parallel with the first direction; and an outlet passage extending in the fifth direction.

BRIEF DESCRIPTION OF THE DRAWINGS

FIG. 2 shows a heat exchanger including the improved serpentine passage of the present invention.

FIG. 3 shows a concave cross-section of a portion of the serpentine passage along line 3—3 of FIG. 2.

FIG. 4 shows a hexalinear cross-section of a portion of the serpentine passage along line 4—4 of FIG. 2.

FIG. 5 shows a cross-section of a clinch hole fastener used in the present invention along line 5—5 of FIG. 2.

DETAILED DESCRIPTION OF THE INVENTION

Figure 1:
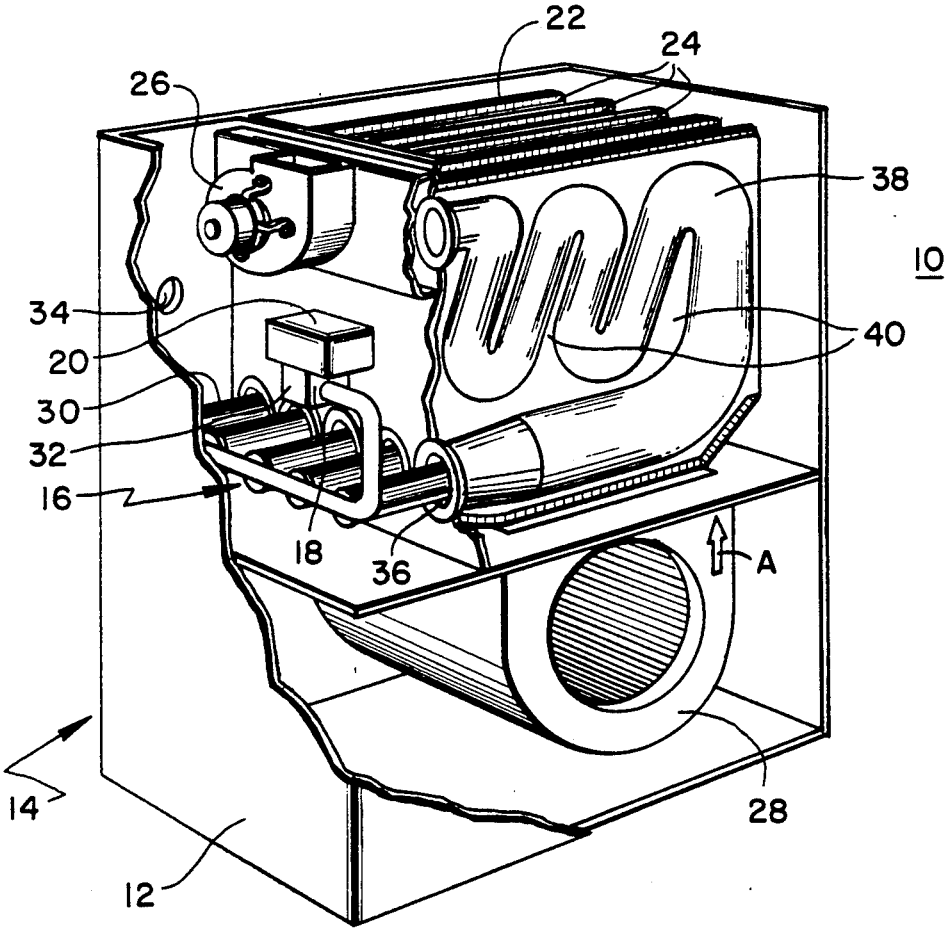
FIG. 1 shows a cutaway view of an upflow gas furnace including which the present invention.

FIG. 1 shows a gas furnace 10 including a cabinet 12; a combustion system 14 including a burner assembly 16, a gas valve assembly 18 and a control assembly 20; a heat exchanger assembly 22 including a plurality of heat exchangers 24; an induced draft blower 26; and a circulating air blower 28. The circulating air blower 28 blows air in the direction indicated by arrow A. Although described as an upflow furnace, the gas furnace 10 of the present invention also applies to other conventional gas furnace types including horizontal and down flow gas furnaces.

The burner assembly 16 of the gas furnace 10 includes a plurality of inshot burners 30 manifolded to a supply of fuel gas. The gas valve assembly 18 includes a gas valve 32 which controls the gas supply so that an appropriate air fuel mixture is provided to the burners 30. The air for the air fuel mixture enters through an air inlet 34. Each burner assembly 16 includes a hot surface ignitor 36 to ignite the air fuel mixture. Each burner 30 directs the resultant combustion into one of the plurality of heat exchangers 24. Each burner 30 is in one-to-one correspondence to a particular heat exchanger 24. The heat exchanger 24, as described more completely below, includes a serpentine passage 38 which provides maximum heat exchange with forced air from the circulating air blower 28 passing between the plurality of heat exchangers 24 and in the interstices 40 formed by the serpentine passage 38. The induced draft blower 26 pulls the flue gases resulting from combustion through the heat exchangers 24 and vents them to a chimney, a vent or the like (not shown).

FIG. 2 shows one of the plurality of heat exchangers 24 for the gas furnace 10. The heat exchanger 24 is formed from a pair of essentially mirror image surfaces 42, 44 which are stamped to form halves of the serpentine passage 38 and then joined together. The surfaces 42, 44 may be formed separately, or as in the preferred embodiment, have an integral, common side 46 which is used as a fold line. Once folded, a long side edge 48 is joined by folding and crimping a linear tab 50. Similarly, an outlet side edge 52 has a linear tab 54 which is folded and crimped to join that edge 52. A burner side edge 56 is joined by folding and crimping a linear tab 58. A fifth, transition edge 60 is formed by cutting away a section of each surface 42, 44 and folding and crimping a linear tab 62. An inlet edge 64 may be joined by folding and crimping a linear tab 66. Alternatively, the inlet edge 64, the transition edge 60, and the burner edge 56 may share a common linear tab 58 as shown in FIG. 2. Means other than linear tabs for joining the edges 48, 52, 56, 60, 64 are contemplated including mechanical fasteners or welding.

The mirror image stamped surfaces 42, 44 form the serpentine passage 38 which commences at an inlet 68 and ends at an outlet 70. The serpentine passage 38 includes a burner path 72, a transition leg 74, a first oblique path 76, a second oblique path 78, a third oblique path 80, a fourth oblique path 82, and an outlet passage 84.

The inlet 68 includes a flange 86 adapted to receive one of the inshot burners 30. An inlet funnel portion 88 joins the flange 86 to the burner path 72. The flange 86 and the funnel portion 88 each have a concave cross-section similar to that shown in FIG. 3. The funnel portion 88 is formed as the concave cross-section gradually increases in cross-sectional area from the flange 86 to the burner path 72.

The burner path 72 also has a concave cross-section which, however, remains constant in cross sectional area and shape for the length of the burner path 72. The burner path 72 is linearly arranged in a first lateral direction as indicated by arrow L.

The transition leg 74 commences at the end 90 of the burner passage 72, and turns the serpentine passage 38 from the first lateral direction L to a second direction as indicated by arrow P which is substantially perpendicular to the first direction. The transition leg 74 has a very gradual, sweeping, and generous radius in the shape of a curved elbow. This is particularly important because the flue gas is hottest at that point. The gradual change in radius helps to reduce hot spots or thermal stresses on the material of the surfaces 42, 44 to increase the life of the heat exchanger. The transition leg 74 is also concave in cross-section. The cross-section of the transition leg 74 gradually decreases in cross-sectional area as the transition leg 74 increases in distance from the end 90 of the burner passage 72.

A first turn 92 commences at the end 94 of the transition leg 74, and turns the serpentine passage 38 approximately 150° so that the end 96 of the first turn 92 points at the burner path 72.

At the end 96 of the first turn 92 begins the first oblique path 76 with which extends linearly toward the burner path 72. The first oblique path 76 is arranged in a third direction, as indicated by arrow Q, which is oblique to the first direction at an angle of approximately 60°, and oblique to the second direction at an angle of approximately 30°. Although the first oblique path 76 is linear, the cross-sectional shape of the serpentine passage 38 undergoes a smooth transition from a concave shape 97 at the end 94 of the transition leg 74, as shown in FIG. 3, to a hexalinear shape 98 at the end 100 of the first oblique path 76, as is shown in FIG. 4. A hexalinear shape 98 is similar to a rectangle or rectilinear shape, but has two sided ends 102 as opposed to single sided ends. The hexalinear shape 98 results from the joining of the surfaces 42, 44, and could be made rectangular if the expense and effort were worth the trouble of doing so. Since the cross sectional area and shape of the serpentine passage 38 are gradually decreasing as the length of the passage 38 increases, and as the passage 38 also transits in the first oblique path 76 from a concave cross-section to a hexalinear cross-section, it should be readily apparent that the cross-sections shown in FIGS. 3 and 4 are exemplary as applied to the entire length of the serpentine passage 38.

A second turn 104 commences at the end 100 of the first oblique path 76 and turns the serpentine passage 38 back upon itself 180°. The second turn 104 has a hexalinear cross-section.

At the end 106 of the second turn 104 begins the second oblique path 78. The second oblique path 78 extends in a fourth direction as indicated by arrow R which is parallel to but opposite the third direction Q. Consequently the second oblique path 78 is also oblique to the first direction at approximately a 60° angle, and oblique to the second direction at approximately a 30° angle. The second oblique path 78 is hexalinear in cross-section but is considerably shorter in length than the first oblique passage 76.

At the end 108 of the second oblique path 78 is a third turn 110. The third turn 110 is hexalinear in cross-section and turns the serpentine passage 38 back upon itself 180°.

The third oblique path 80 commences at the end 112 of the third turn 110. The third oblique path 80 extends in the third direction Q. The first and third oblique paths 76, 80 are similar in length and direction although the width and hexalinear cross-section of the third oblique path 80 are smaller than the corresponding dimensions at the end 100 of the first oblique path 76.

A fourth turn 114 commences at the end 116 of the third oblique path 80, and turns the serpentine passage 38 back upon itself 180°. The cross-section of the fourth turn 114 is also hexalinear.

At the end 118 of the fourth turn 114 begins the fourth oblique path 82. The fourth oblique path 82 is hexalinear in cross-section and extends in the fourth direction R. The fourth oblique path 82 is similar in direction and length to the second oblique path 78, although the cross-sectional width and area of the fourth oblique path 82 are somewhat less than in the second oblique path 78.

An outlet turn 120 commences at the end 122 of the fourth oblique path 82, and turns the serpentine passage 38 approximately 60° to a fifth direction which is parallel to but opposite the first direction L. The outlet turn 120 is hexalinear in cross-section and has an end 124 which connects to the outlet passage 84.

The outlet passage 84 also extends in the fifth direction which is parallel to but opposite the first direction L. The outlet passage 84 ends in a flange 126 adapted for reception by the induced draft blower 26. The outlet flange 126 and the outlet passage 84 are each essentially hexalinear in cross section having a slightly greater width than the width of the fourth oblique path 82.

In addition to being held together by the edges 52, 56, 60, 64, and 48, the surfaces 42, 44 are also held together by clinch holes 128, 130, 132 and 134 respectively located in a burner land 136 located between the burner path 72, the third oblique path 80 and the second oblique path 78; a transition land 138 located between the first oblique path 76 and the transition leg 74; an oblique land 140 located between the first oblique path 76, the second oblique path 78 and the long side edge 48; and an outlet land 142 located between the long side edge 48, the outlet turn 120 and the third oblique path 80. As shown in FIG. 5, the clinch holes 128, 130, 132 and 134 are formed by punching through the surfaces 42, 44 and wrapping the extruded portions back to overlap the surfaces 42, 44.

The oblique land 140 includes a peninsula 144 extending between the first and second oblique paths 76, 78. The burner land 136 includes a peninsula 146 extending between the second and third oblique paths 78, 80, while the outlet land 142 includes a peninsula 148 extending between the third and fourth oblique paths 80, 82. These peninsulas 144, 146 and 148 and the various lands including the oblique land 140, the burner land 136, the outlet land 142, and the transition land 138 form the interstices 40 which facilitate heat transfer. Additionally, these peninsulas 144, 146, 148 are very narrow so as to eliminate potential cold spots.

A further cold spot in previous gas furnace heat exchangers is eliminated by controlling the cross-sectional area of the transition leg 74, by providing the curved elbow shape in the transition leg 74, and by eliminating a corner 156 (shown in dotted outline) formerly adjacent the transition edge 60. This increases heat transfer efficiency while providing improved airflow by increasing the area between the circulating air blower 28 and the heat exchangers 24.

What has been described is an improved serpentine passage for the combustion gas of a heat exchanger for a gas furnace. The serpentine passage, from the outlet going toward the inlet, is in the general shape of a slanting or leaning cursive w which has a non-terminating trailing end curling downwardly and toward the inlet so as to underline the cursive w. The serpentine passage is longer than previous passages, and the cross-sectional area and shape of the serpentine passage gradually decrease as the serpentine passage increases in distance from the inlet. However, the dimensions of the heat exchanger are more compact due to the arrangement of oblique paths forming the serpentine passage.

Although the present invention has been described in connection with the preferred embodiment above, it is apparent that many alterations and modifications are possible without departing from the present invention. For instance, although the present invention has been described in terms of an up flow gas furnace, the heat exchanger arrangement described herein is applicable to most other gas furnaces. Additionally the 60° oblique angle may change somewhat as long as all other angles are correspondingly adjusted. For instances, the 60° angle could range between 50° and 70°. Additionally, the first, second, third and fourth oblique paths 76, 78, 80 and 82 could vary slightly from the parallel arrangement shown in FIG. 2. Also, dimples to facilitate heat exchange could be added to the flat passage areas of the hexalinear cross-section shown in FIG. 4. It is intended that all such alterations and modifications be considered within the spirit and scope of the invention as defined in the following claims.

What is claimed and desired to be secured by Letters Patent of the United States is:

1. A serpentine passage for a gas furnace claim shell-type heat exchanger comprising:

a serpentine passage having an inlet and an outlet where the serpentine passage, from the outlet toward the inlet, is shaped as a leaning, cursive w with a trailing end having a first portion curling downwardly and a second portion underling the w wherein the w is formed by four oblique paths which are substantially parallel to each other and wherein the four oblique paths are at an angle relative the second portion of between 50 and 70 degrees.

2. A furnace heat exchanger comprising a pair of joined generally planar surfaces having a serpentine passage shaped therebetween, the passage including:

an inlet;

an outlet;

a burner path connected to the inlet and extending in a first direction;

a transition leg connected to the burner path and altering the serpentine passage to a second direction substantially perpendicular to the first direction;

a first oblique path connected to the transition leg and extending in a third direction toward the burner path, where the third direction is oblique to the first direction and to the second direction;

a second oblique path connected to the first oblique path and extending in a fourth direction away from the burner path where the fourth direction is generally parallel to the third direction;

a third oblique path connected to the second oblique path and generally extending in said third direction;

a fourth oblique path connected to the third oblique path and generally extending in said fourth direction;

an outlet leg connected between the fourth oblique path and the outlet; and wherein the serpentine passage has a cross-section which gradually changes from an elliptical shape at the burner path to a rectangular shape at the end of the first oblique path.

3. A furnace heat exchanger comprising a pair of joined generally planar surfaces having a serpentine passage shaped therebetween, the passage including:

an inlet;

an outlet;

a burner path connected to the inlet and extending in a first direction;

a transition leg connected to the burner path and altering the serpentine passage to a second direction substantially perpendicular to the first direction;

a first oblique path connected to the transition leg and extending in a third direction toward the burner path, where the third direction is oblique to the first direction and to the second direction and where the third direction is at an angle relative to the first direction of between 50 and 70 degrees;

a second oblique path connected to the first oblique path and extending in a fourth direction away from the burner path where the fourth direction is generally parallel to the third direction;

a third oblique path connected to the second oblique path and generally extending in said third direction;

a fourth oblique path connected to the third oblique path and generally extending in said fourth direction; and an outlet leg connected between the fourth oblique path and the outlet.

4. The heat exchanger of claim 3 wherein the angle of the third direction relative to the first direction is approximately 60 degrees.

5. The heat exchanger of claim 4 wherein the outlet leg is generally parallel to the burner path.

6. The heat exchanger of claim 3 wherein the burner path and the transition leg are elliptical in cross-section.

7. The heat exchanger of claim 6 wherein the burner path is linear.

8. The heat exchanger of claim 7 wherein the burner path includes a flare at the inlet, and the transition leg is shaped as a curved elbow.

9. The heat exchanger of claim 3 wherein the pair of planar surfaces are integral on one side.

10. The heat exchanger of claim 9 wherein the integral side is cut away at one corner.

11. The heat exchanger of claim 3 wherein the pair of planar surfaces are joined by at least one clinch hole fastener.

12. The heat exchanger of claim 3 wherein the serpentine passage gradually decreases in cross-sectional width and area as the passage moves away from an inlet end of the burner path.

13. The heat exchanger of claim 3 wherein the first, second, third and fourth oblique path each include a linear portion which has a generally hexalinear cross-section.

14. A furnace heat exchanger comprising a pair of joined generally planar surfaces having a serpentine passage shaped therebetween, the passage including:

an inlet;

an outlet;

a burner path connected to the inlet and extending in a first direction;

a transition leg connected to the burner path and altering the serpentine passage to a second direction substantially perpendicular to the first direction;

a first oblique path connected to the transition leg and extending in a third direction toward the burner path, where the third direction is oblique to the first direction and to the second direction;

a second oblique path connected to the first oblique path and extending in a fourth direction away from the burner path where the fourth direction is generally parallel to the third direction;

a third oblique path connected to the second oblique path and generally extending in said third direction;

a fourth oblique path connected to the third oblique path and generally extending in said fourth direction; and an outlet leg connected between the fourth oblique path and the outlet wherein the serpentine passage has a cross-section which gradually changes from an elliptical shape at the burner path to a hexalinear shape at the end of the first oblique path.

15. The heat exchanger of claim 3 wherein the oblique paths are separated by narrow peninsulas.

16. A serpentine path from an inlet of a furnace heat exchanger to an outlet of a furnace heat exchanger comprising:

a burner path connected to an inlet and linearly running in a first direction;

a transition leg connected to the burner leg and turning the serpentine path from the first direction to a second direction which is substantially perpendicular to the first direction;

a first turn connected to the transition leg and turning the serpentine path from the second direction to a third direction which is oblique to the second direction;

a first oblique leg connected to the first run and extending in the third direction toward the burner path;

a second turn connected to the first oblique leg and turning the serpentine path approximately 180°;

a second oblique leg connected to the second turn and extending in a fourth direction which is substantially parallel to the third direction;

a third turn connected to the second oblique leg and turning the serpentine path approximately 180°;

a third oblique leg connected to the third turn and extending in said third direction;

a fourth turn connected to said third oblique leg and turning the serpentine path approximately 180°;

a fourth oblique leg connected to said fourth turn and extending in said fourth direction;

an outlet turn connected to said fourth oblique leg and turning the serpentine path in a fifth direction which is opposite to and parallel with said first direction; and an outlet passage extending in said fifth direction wherein the third direction is at an angle relative to the first direction of between 50 and 70 degrees.

* * * * *